US008946498B2

(12) United States Patent
Cho et al.

(10) Patent No.: US 8,946,498 B2
(45) Date of Patent: Feb. 3, 2015

(54) APPARATUS AND METHOD FOR THE GRANULATION OF RADIOACTIVE WASTE, AND VITRIFICATION METHOD THEREOF

(75) Inventors: Hyun-je Cho, Yuseong-gu Daejeon (KR); Deuk-man Kim, Seo-gu Daejeon (KR); Cheon-woo Kim, Yuseong-gu Daejeon (KR); Jong-kil Park, Gyeonggi-do (KR); Young-bu Choi, Yeonggwang-gun Jeollanam-do (KR)

(73) Assignee: Korea Hydro Nuclear Power Co., Ltd, Gyeongsangbuk-Do (KR)

( * ) Notice: Subject to any disclaimer, the term of this patent is extended or adjusted under 35 U.S.C. 154(b) by 129 days.

(21) Appl. No.: 13/821,031

(22) PCT Filed: Sep. 27, 2010

(86) PCT No.: PCT/KR2010/006556

§ 371 (c)(1),
(2), (4) Date: Mar. 6, 2013

(87) PCT Pub. No.: WO2012/039521

PCT Pub. Date: Mar. 29, 2012

(65) Prior Publication Data

US 2013/0178685 A1 Jul. 11, 2013

(30) Foreign Application Priority Data

Sep. 20, 2010 (KR) ..... 10-2010-0092634

(51) Int. Cl.

| | |
|---|---|
| ***G21F 9/28*** | (2006.01) |
| ***G21F 9/30*** | (2006.01) |
| ***B30B 11/20*** | (2006.01) |
| ***B30B 11/22*** | (2006.01) |

(52) U.S. Cl.

CPC ..... *G21F 9/30* (2013.01); *B30B 11/201* (2013.01); *B30B 11/228* (2013.01); *G21F 9/28* (2013.01); *G21F 9/305* (2013.01); *G21F 9/301* (2013.01); *Y10S 588/90* (2013.01); *Y10S 422/903* (2013.01)

USPC ..... 588/19; 588/900; 422/159; 422/903

(58) Field of Classification Search

USPC ..... 588/19, 900; 422/159, 903

See application file for complete search history.

(56) References Cited

U.S. PATENT DOCUMENTS

| | | | |
|---|---|---|---|
| 4,671,897 | A | 6/1987 | Mori et al. |
| 4,931,222 | A | 6/1990 | Baba et al. |
| 5,380,922 | A | 1/1995 | Beach et al. |
| 6,576,807 | B1 | 6/2003 | Brunelot et al. |
| 7,108,808 | B1 | 9/2006 | Richards |

FOREIGN PATENT DOCUMENTS

| | | | |
|---|---|---|---|
| FR | 2 742 256 | A1 | 6/1997 |
| KR | 10-1999-0050832 | A | 7/1999 |
| KR | 10-0933561 | B1 | 12/2009 |

OTHER PUBLICATIONS

Korean Intellectual Property Office, International Search Report in International Patent Application No. PCT/KR2010/006556, (Oct. 27, 2011).

*Primary Examiner* — Edward Johnson

(74) *Attorney, Agent, or Firm* — Leydig, Voit & Mayer, Ltd.

(57) ABSTRACT

An apparatus and method for the granulation of radioactive waste in which a preprocessing method for the vitrification of radioactive waste is simplified to conform to onsite conditions of a nuclear power plant, additives are improved, and pellets suitable for vitrification are manufactured. The apparatus for the granulation of radioactive waste includes: a body frame having an inlet and an outlet; a hopper supplying the radioactive waste to be transferred and fed through the inlet; a feeder transferring/supplying the radioactive waste supplied to a specific position and in a certain quantity; a stirrer pulverizing/mixing lumps of the radioactive waste supplied; an additive supply part supplying a lubricant to the radioactive waste fed into the stirrer; and a pellet press pressing the radioactive waste fed through the feeder into a pellet shape and discharging the pellet through the outlet.

9 Claims, 8 Drawing Sheets

APPARATUS AND METHOD FOR THE GRANULATION OF RADIOACTIVE WASTE, AND VITRIFICATION METHOD THEREOF

TECHNICAL FIELD

The present invention relates to an apparatus and method for the granulation of radioactive waste, and a vitrification method using the pellets, and more particularly, to an apparatus and method for the granulation of radioactive waste to manufacture the powder-form radioactive waste into pellet form convenient for using in a vitrification facility, and a vitrification method using the same.

BACKGROUND ART

Generally, for in-country case, radioactive waste was firm-processed with cement, but was suspended due to increase of volume that originated from large quantity of firming material. Afterwards, paraffin firm-processing is being done, but paraffin firming agent is difficult to satisfy acceptable criteria for radioactive waste disposal area.

In case of US, research on developing procedures using ceramic low-temperature melting furnace is being performed to vitrify nuclear power plant originated radioactive wastes. In terms of hardening radioactive wastes using cement, there have been occurrences of weaknesses such as iron corrosion and wastewater following the long-term storage in Westinghouse, US, ORNL (Oak Ridge National Laboratory), Hitachi, Japan, and INER (Institute of Nuclear Energy Research), Taiwan, and in terms of polymer solidification, reconsideration of polymer degradation reaction on high-dose radioactive waste in DTS (Diversified Technologies Services Company), US, and Grenoble Nuclear Power Plant, France.

Therefore application of vitrification, which improved the weakness of previous hardening methods on radioactive wastes while having excellent processing effect and eco-friendliness, was considered.

Meanwhile, pelletizing method, granulation method and injection method are being suggested for pre-processing the radioactive waste, and the results following were shown as Table 1.

TABLE 1

Comparative analysis on pre-processing method

| Pre-processing method | Final product | Installation condition | Maintenance | Operation convenience | Washing |
|---|---|---|---|---|---|
| Pelletizing method | Good | Good | Good | Good | Unnecessary |
| Granulation method | Inappropriate | Average | Average | Average | Necessary |
| Injection method | Inappropriate | Average | Difficult | Difficult | Necessary |

Pelletizing method is in general a method of producing medication tablets, and can be separated into method of manufacturing by mixing powder with additive (binder, excipient, lubricant, disintegrating agent) and granulating (wet assembly, dry assembly), and method of manufacturing by adding force directly into powder after mixing the powder with additive without granulation process. Additives are used to improve hardness and friability, and various additives such as PVA (Polyvinyl alcohol), HPMC (Hydroxypropyl methylcellulose), HPC (Hydroxypropylcellulose), Kollidon VA 64 are used.

FIG. 1 is a method of making radioactive waste powder into tablets, which is a method of pre-processing radioactive waste following the conventional art, and is a procedure flow chart that shows tablet formulation method of radioactive waste powder which was previously applied as Registered Patent No. 10-0933561.

Referred to FIG. 1, an apparatus for tabletizing radioactive waste is formed with mixer (A), powder molding press (B), and coating apparatus (C). The radioactive waste is mixed with binder and lubricant in mixer (A), made into tablets with powder molding press (B), and is formed with coating in coating apparatus (C).

However, the conventional apparatus for tabletizing radioactive waste is formed with mixer (A), powder molding press (B), and coating apparatus (C), so it is difficult to be applied when considering the small installation space of nuclear power plant. Also, the tablet manufacture method of the prior art has weakness of complex procedures, and it requires drying apparatus to maintain the moisture level of radioactive waste lower than 0.5%. Also, various additives (binder, lubricant, coating agent) are used, so handling and mixing procedures are complicated, and standard of tablet, which is the most basic item when applied to a vitrification facility, is not provided. Moreover, radioactive waste has potential of pollute expansion via dispersing as small particles, which requires pollution spread preventing apparatus, but such apparatus did not exist before.

Also, when vitrifying radioactive waste, glass composition developing procedure is needed to develop the needed glass composition. Radioactive waste vitrification is different from general industries' vitrification, by having enough standards to prevent radiation-emitting radioactive wastes from leaking into environments by locking up in glass structure, and such standard must not be problematic when applied to a vitrification facility.

DISCLOSURE OF THE INVENTION

Technical Problem

Exemplary embodiments of the present invention provide an apparatus and method of granulating radioactive waste to simplify pre-processing method for vitrification of radioactive waste suitable for nuclear power plants' field condition, improve the mixed additives and enable manufacture of pellets suitable for vitrification.

Also, other exemplary embodiments of the present invention provide a vitrification method to make the vitrified solid suitable for related laws and policies by developing glass composition needed for vitrifying radioactive wastes.

Technical Solution

Embodiments of the present invention provide an apparatus for the granulation of radioactive waste including: a body frame having an inlet and an outlet; a hopper supplying the radioactive waste to be transferred and fed through the inlet; a feeder transferring/supplying the radioactive waste supplied through the hopper to a specific position and in a certain quantity; a stirrer pulverizing/mixing lumps of the radioactive waste supplied through the hopper; an additive supply part disposed at a side of the stirrer to supply a lubricant into the radioactive waste fed into the stirrer; and a pellet press pressing the radioactive waste fed through the feeder into a pellet shape and discharging the pressed radioactive waste through the outlet.

The apparatus may further include a pollution spread preventing film installed around the body frame to prevent any possible pollution spread that may occur during the procedure of manufacturing pellet.

Also, the apparatus may further include an exhaust pipe installed on top part of the pollution spread preventing film to discharge dust created inside.

Also, the apparatus may further include a sleeve glove equipped on a side of the body frame for internal inspection and work.

Other embodiments of the present invention provides a method of pelletizing radioactive waste including: analyzing compositions, particle size and distribution of the radioactive waste; adding a certain amount of lubricant into the radioactive waste and mixing together; feeding the mixed radioactive waste into a pellet press through the hopper and pressing into a pellet shape; determining whether the manufactured pellet is suitable for the criteria and making adjustments; transferring the manufactured pellets into vitrification facility.

Also, the criteria for the manufactured pellets may be with 4-7 kp hardness and 2% friability or less.

Also, the lubricant may be used with one of stearate, magnesium stearate and calcium stearate, and it is characterized with 0-2 wt % for quantity added.

Also, the pellet press may manufacture the radioactive waste into pellet shape by pressing the radioactive waste with 70-80 kg/mm$^2$ pressure.

Other embodiments of the present invention provide a vitrification method including: identifying matter of change in composition of the radioactive waste by analyzing the physical and chemical attributes of radioactive waste provided from the analyzing of the compositions, particle size and distribution of the radioactive waste; identifying matter of vitrification through glass composition and attribute modeling based on the analyzed data; identifying suitability in vitrification through laboratory characteristic experiments based on the modeling results; and approving soundness of vitrified solid through practical experiment and attribute experiments based on the result of laboratory.

Advantageous Effects

The apparatus and method for the granulation of radioactive waste according to the present invention and the vitrification method using the same can provide pellet criteria suitable for vitrification and simplified apparatus and processes suitable for nuclear power plant field condition.

Also, quality management system of vitrified solid can be established via radioactive waste vitrification procedure, and advantage of producing the vitrified solid, a final product of vitrification, to be suitable for the related laws and policies exists, since it is possible to develop appropriate glass composition following changes in the physical and chemical attributes of radioactive waste.

DESCRIPTION OF SYMBOLS

Figure 1:
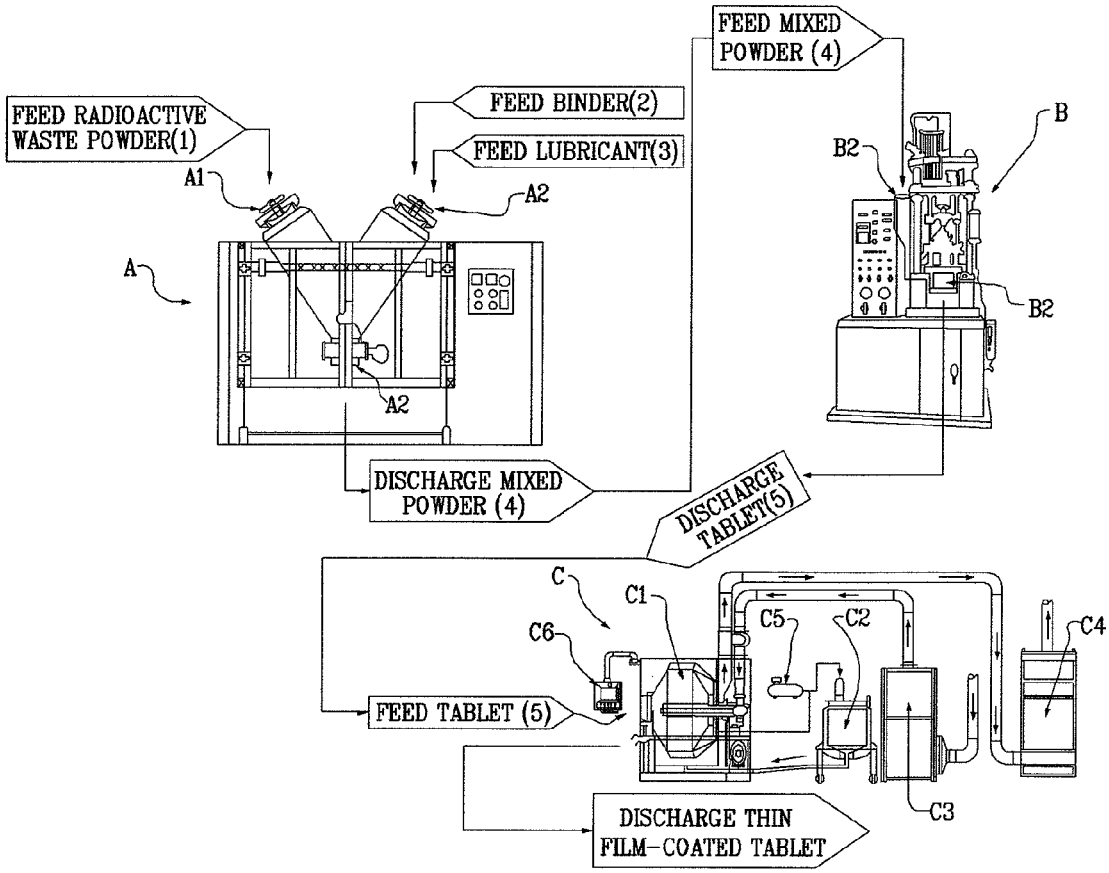
FIG. 1 is a process flowchart that shows the prior method of tabletizing radioactive waste powder.

| | | | |
|---|---|---|---|
| 100 | Pelletizing apparatus | 110 | Body frame |
| 111 | Inlet | 113 | Outlet |
| 120 | Hopper | 121 | Supply valve |
| 130 | Stirrer | 140 | Additive feeding part |
| 150 | Feeder | 160 | Pellet press |
| 161 | Supporter | 161a | Extruding hole |
| 163 | Pressure roller | | |

MODE FOR CARRYING OUT THE INVENTION

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in detail since they would obscure the invention with unnecessary detail.

Figure 2:
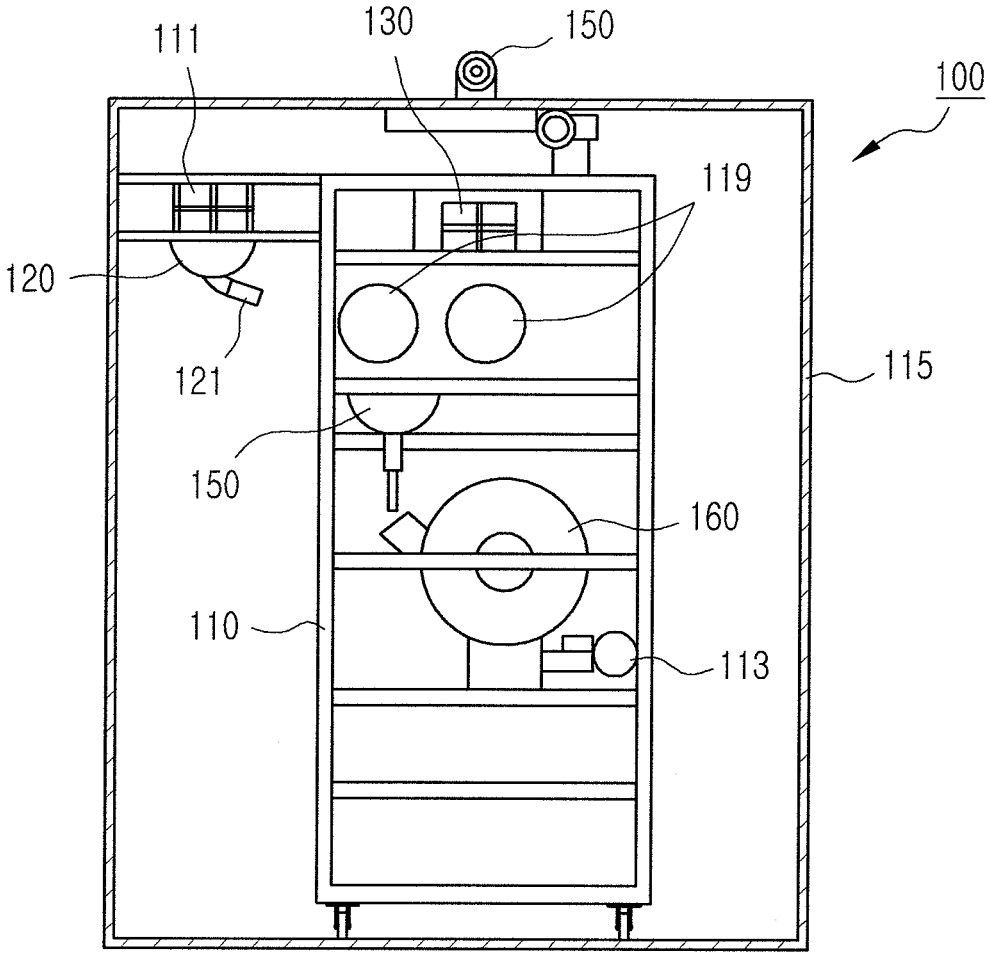
FIG. 2 is an inner view of the radioactive waste pelletizing apparatus according to the present invention.
Figure 3:
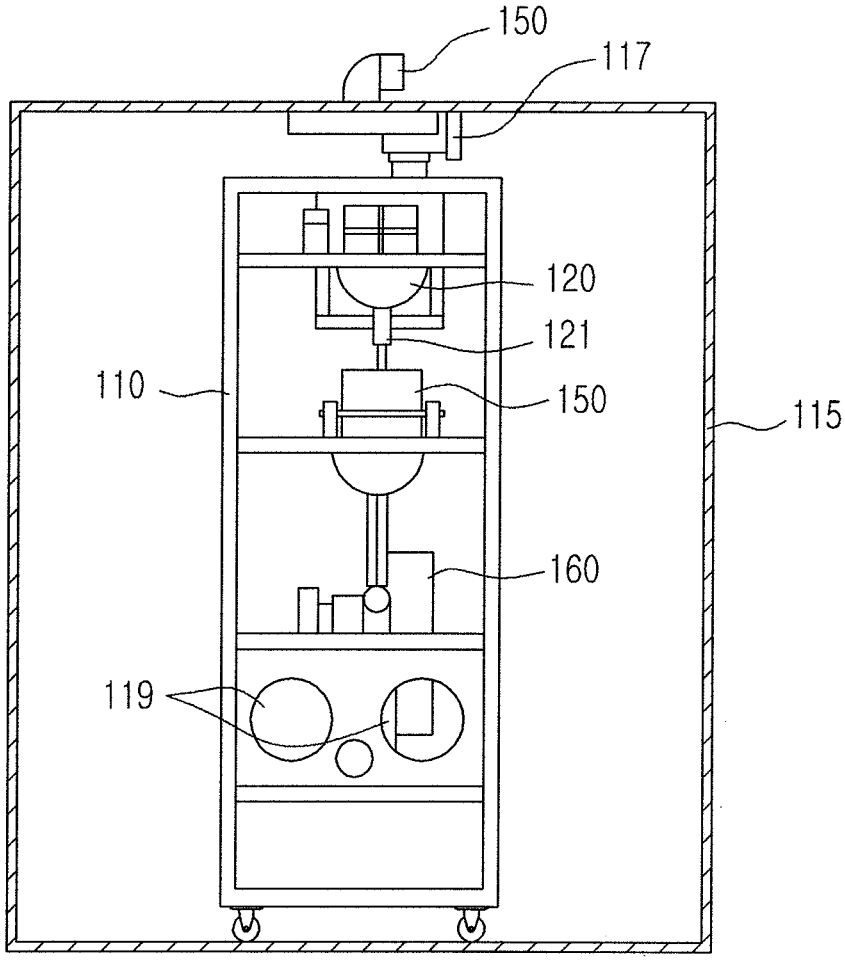
FIG. 3 is side view of the radioactive waste pelletizing apparatus according to the present invention.
Figure 4:
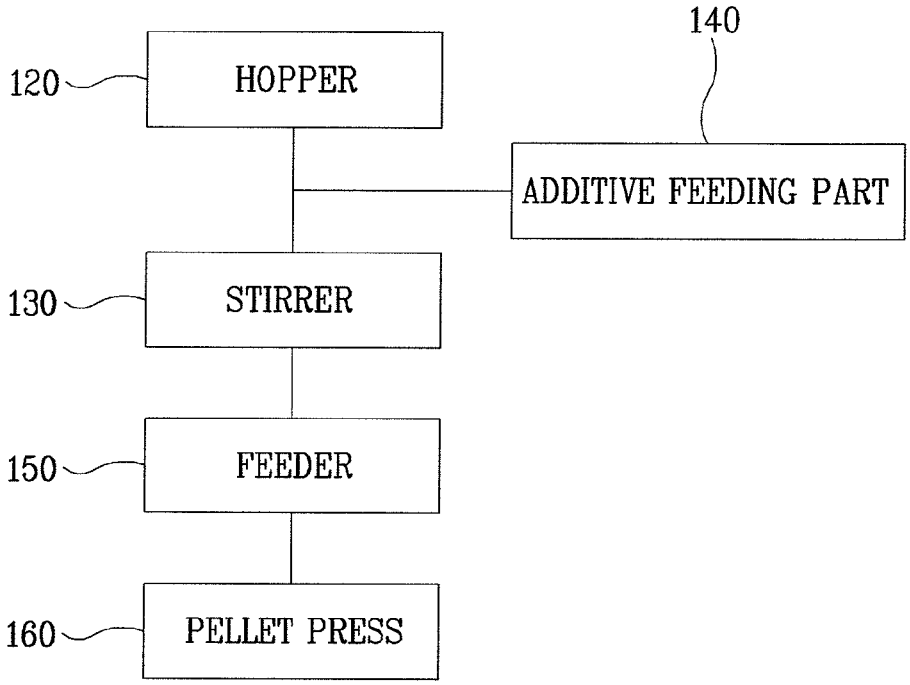
FIG. 4 is schematic view of the radioactive waste pelletizing apparatus according to the present invention.
Figure 5:
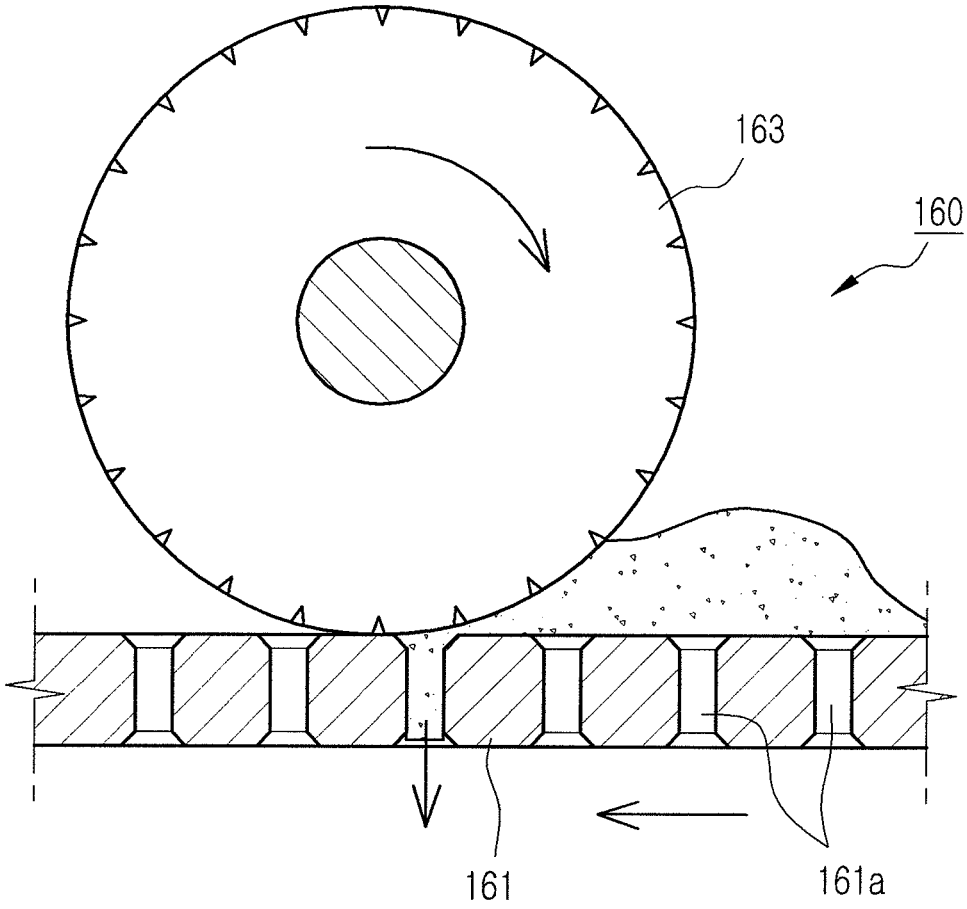
FIG. 5 shows an embodiment of a pellet press according to the present invention.

FIG. 2 is an inner view of a radioactive waste pelletizing apparatus according to the present invention, FIG. 3 is side view of a radioactive waste pelletizing apparatus, FIG. 4 is a schematic view of a radioactive waste pelletizing apparatus, and FIG. 5 shows an embodiment of a pellet press.

Referring to FIGS. 2 and 3, radioactive waste pelletizing apparatus 100 according to the present invention is used to allow radioactive wastes generated from pressurized light water reactor nuclear power plant to be conveniently put into vitrification facility, and includes body frame 110, hopper 120, stirrer 130, feeder 150, and pellet press 160.

The configuration of the present invention will now be described in detail as follows.

First, body frame 110 forms main body, having prepared of inlet 111 where radioactive waste is supplied at the top part, and outlet 113 is prepared at the bottom part to allow radioactive wastes be manufactured and discharged in pellet form after going through manufacture procedures.

On a side of inlet 111, hopper 120, which supplies the transferred radioactive waste into certain location, is installed. Supply valve 121 is installed at the exhaust pipe of hopper 120 to enable selective supply/blockage of the radioactive waste. In this case, supply form of radioactive waste supplied to hopper can be in placement or continuous form, and transferring process can be applied of dry-type transfer method, which moves mixtures via air.

On lower side of hopper 120, stirrer 130 that pulverizes and mixes lumps of the radioactive waste supplied through the hopper is installed. In addition, as shown in FIG. 4, additive supply part 140 is installed at a side of the stirrer to supply lubricant into the radioactive waste fed into the stirrer. Additive supply part 140 maximizes load of radioactive waste vitrify by adding/mixing small amount of lubricant to radioactive waste, and in addition provides fluidity to radioactive waste and enables the waste to be separated easily from molding, which helps it to be manufactured into pellet shape fluently. In this case, lubricant supplied from additive supply part 140 is used from one of three substances with low shearing force, stearate, magnesium stearate and calcium stearate, and it is desirable to have 0-2 wt % for quantity added for lubricant.

In this case, the present invention used the case of the additive supply part 140 installed between hopper 120 and stirrer 130 as an example to make explanation, but it is not limited thereof and may be changed and applied with various structures as long as the configuration is able to add lubricant and mix with the input radioactive waste. For example, it is obvious that the additive supply part 140 may be installed to the side of extra mixing equipment (not shown) before the radioactive waste is input into hopper 120 so that configuration is formed in a way that small amount of lubricant is put and mixed with the radioactive waste, then input the mixed mixture into hopper 120.

Feeder 150 is installed on lower side of stirrer 130. Feeder automatically adjusts supply quantity of radioactive waste that is discharged and supplied via outlet of stirrer 130 to supply to pellet press 160.

Pellet press 160 manufactures radioactive waste supplied of fixed quantity through feeder 150 into pellet shape by pressing with certain amount of pressure. For example, as shown in FIG. 5, the pellet press 160 can be formed with support 161 that multiple numbers of extruding holes 161*a* are penetrating, and pressure roller 163 that is bearing-bound with the top part of the support under rolling contact and presses the supplied radioactive waste with extruding holes 161 into pellet shape. Pellet press 160 with such configuration presses radioactive waste with 70-80 kg/mm$^2$ pressure into pellet shape.

As such, the supplied radioactive waste becomes pellet in pellet press 160 and the size of molding where pellet is manufactured may be adjusted depending on the analyzed particle size and particle size distribution. The manufactured pellet may be discharged through outlet 113 connected via pipe with a side of pellet press 160, and may be stored in drum for transfer.

Meanwhile, pollution spread preventing film 115 is installed around body frame to prevent any possible pollution spread that may occur during the procedure of manufacturing pellet. In addition, exhaust pipe 117 is installed on top part of the pollution spread preventing film 115 to remove radioactive waste in case it scatters during operation of pelletizing apparatus 100. Exhaust pipe 117 is processed by having it connected to exhaust pipe of nuclear power plant.

Also, on a side of the pollution spread preventing film 115, sleeve glove is equipped to enable workers to deal with internal inspections and tasks for pelletizing apparatus 100.

The pelletizing procedure of radioactive waste using pelletizing apparatus according to the present invention with the configuration will be explained in detail with reference to FIG. 6.

Figure 6:
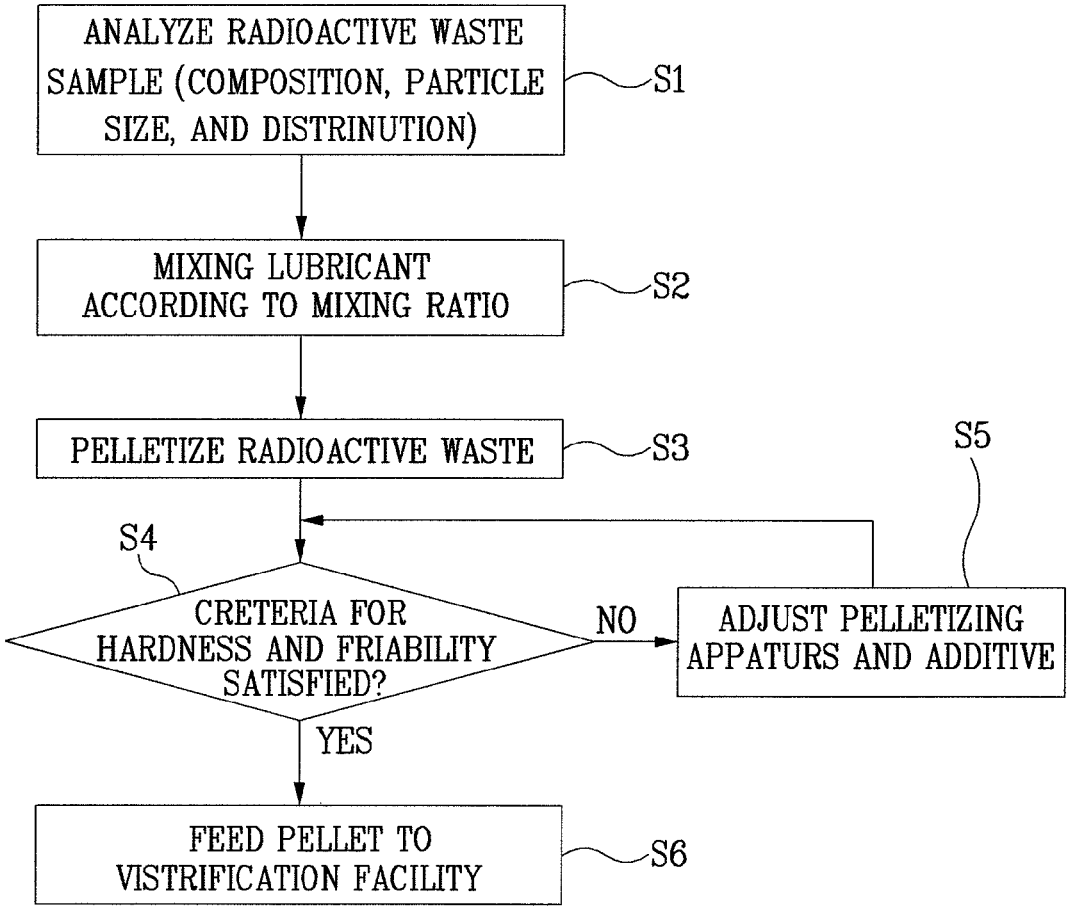
FIG. 6 is a block diagram that shows a method of pelletizing radioactive waste according to the present invention.

FIG. 6 is a block diagram showing radioactive waste pelletizing method according to the present invention.

First, constituent analysis is done for the waste dried from CWDS of pressurized light water reactor nuclear power plant or similar drying system. Items of analysis include organic and inorganic material content, water content, particle size and particle size distribution, and items of analysis may be added depending on apparatus condition (S1).

Radioactive waste is mixed with lubricant, an additive. Such mixing procedure is done before putting the radioactive waste into pelletizing apparatus 100, using commercial apparatus or waste drum to add certain amount of lubricant into radioactive waste and mix (S2).

The mixture with lubricant mixed is input via hopper 120, and mixture is supplied into feeder 150 by opening hopper supply valve 121. At this time, upper part of feeder 150 is installed with a stirrer 130 to pulverize lumps of the mixture, and the pulverized mixture is supplied to pellet press 160 while the supply quantity is automatically adjusted by feeder 150. The supplied mixture is pressed and manufactured into pellet shape via pellet press 160 (S3).

Whether the manufactured pellet is suitable for the criteria is determined and adjustments are made. Hence, whether the produced pellets are able to be put into vitrification facility is identified. The criteria appropriate for putting into vitrification facility was set up based on structure of vitrification facility. The inlet of vitrification facility is approximately 2 m, so pellet must not crumble, break or crack from 2 m downfall experiment to be suitable for input. When hardness of effective pellet in 2 m experiment was done to apply the criteria of breakage, it was over 4 kp. Crumbling may affect characteristic or vitrification facility' exhausted gas. When tested with using approximately 2% sample for friability, there was no influence for exhaust system. Therefore, the criteria are 4-7 kp hardness, and less than 2% friability. Mock sample was used to perform verification experiment and radioactive waste was used to be reconfirmed (S4).

If the manufactured pellet does not satisfy the criteria, pelletizing procedure is performed again by going through procedure of adjusting lubricant and pelletizing equipment (S5).

If the measurement result satisfies the criteria, the manufactured pellet is transferred to vitrification facility (S6).

Figure 7:
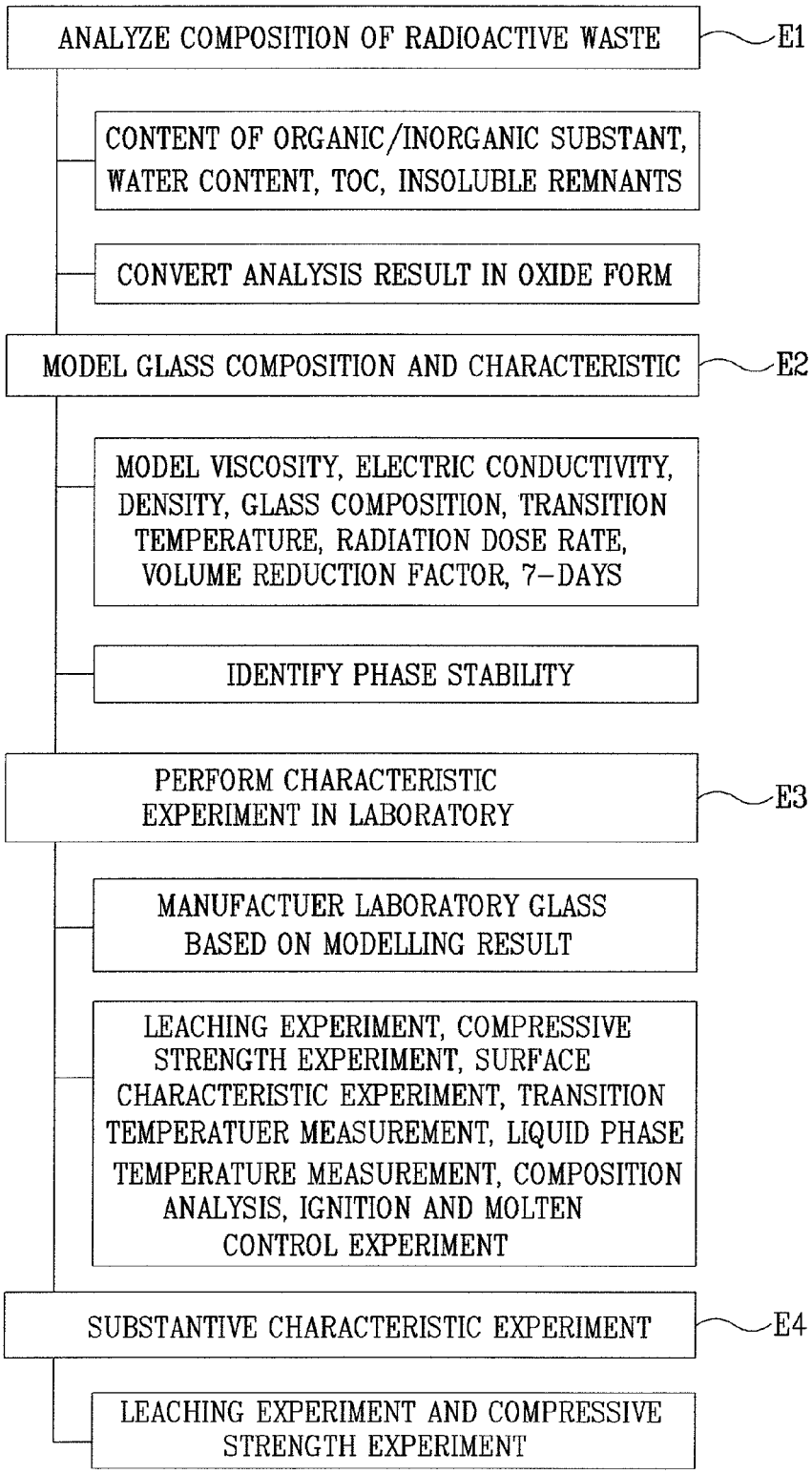
FIG. 7 is block diagram that shows a vitrification method of radioactive waste according to the present invention.

FIG. 7 is block diagram that shows vitrification method of radioactive waste according to the present invention.

Referring to FIG. 7, in step 1 (E1), data for organic and inorganic material content, water content, TOC, insoluble remnants is provided at radioactive waste sample analysis procedure (S1), and inorganic material content is converted into oxide form.

In step 2 (E2), glass composition and characteristic are modeled based on the data provided from step 1 (E1) and matter of vitrification is determined. Target for modeling may include viscosity, electric conductivity, density, glass composition, transition temperature, radiation dose rate, volume reduction factor, 7-days PCT, etc. also, phase safety is identified. Criteria for each is, 10-100 poise for viscosity, 0.1-1.0 S/cm for electric conductivity, 2.5 g/cm$^3$ for density, no occurrence of secondary phase, less than 10 mSv/hr for radiation dose rate. PCT criteria is different for each composition, less than 9.155 g/m$^2$ for B, less than 5.015 g/m$^2$ for Li, less than 6.99 g/m$^2$ for Na and less than 2.12 g/m$^2$ for Si.

In step 3 (E3), glass ingredients are combined based on the data provided from step 2 (E2) to manufacture glass in laboratory, and suitability of vitrification is identified via characteristic experiment in laboratory. The experimental criteria for glass manufacture in laboratory include, liquid phase temperature, transition temperature, ignition and molten metal control, glass ingredients, surface uniformity, compressive strength, leaching ratio. Liquid phase temperature is an experiment identifying matter of glass crystallization depending on temperature, which is lower than 1,150, the operation temperature of cold crucible melter. The leaching experiment is applied with 7-days PCT, and experiment criteria is equal to step 2 (E2) and in case of compressive strength experiment, it is over 500 psi. Transition temperature and liquid phase temperature are measured while analyzing surface attribute and components of the manufactured glass. Also, experiment of confirming controllability for ignition and molten metal is done within vitrification facility.

In step 4 (E4), substantiating experiment is done based on the results identified from step 2 (E2) and step 3 (E3) to demonstrate soundness of vitrified solid. The items of experiment include leaching experiment and compressive strength experiment, having same criteria as step 3 (E3). When experiments of step 4 satisfy the criteria, the final vitrification procedures are completed.

Examples

Example for vitrifying radioactive waste is as follows.

First, composition analysis is performed after collecting sample of the radioactive waste and the analysis result is as follows.

TABLE 2

| Elemental content | | Oxide content | |
|---|---|---|---|
| Element | Content (ppm) | Oxide | Content (wt %) |
| B | 195,333 | $B_2O_3$ | 62.98 |
| Na | 76,000 | $Na_2O_3$ | 10.29 |
| K | 2,333 | $K_2O$ | 0.38 |
| Ca | 1,600 | CaO | 0.36 |
| Zn | 583 | ZnO | 0.10 |
| Mg | 495 | MgO | 0.08 |
| Si | 391 | $SiO_2$ | 0.08 |
| Fe | 230 | $Fe_2O_3$ | 0.06 |
| Li | 127 | $Li_2O$ | 0.06 |
| Mn | 77 | $Al_2O_3$ | 0.03 |
| TOC | 6,262 | Water content | 25.55 |
| Total | 283,504 | Total | 100 |

Herein, the TOC (Total Organic Carbon) means amount of carbon dissolved in solution dissolved with acid.

Radioactive waste is found to be in form of compound with mostly oxides of B and Na bound with water, rather than boric acid ($H_3BO_3$).

The particle size and distribution of radioactive waste are as follows.

TABLE 3

Particle size and distribution table of radioactive waste

| Particle size distribution | Less than 75 μm | 75 μm | 150 μm | 250 μm | 500 μm | Total |
|---|---|---|---|---|---|---|
| Sample A | 9.2 g | 41.5 g | 55.1 g | 28.1 g | 16.5 g | 150.4 g |
| Sample B | 2.5 g | 6 g | 32 g | 81.1 g | 30 g | 151.6 g |
| Total | 11.7 g | 46.6 g | 85.1 g | 109.2 g | 46.5 g | 302 g |

Figure 8:
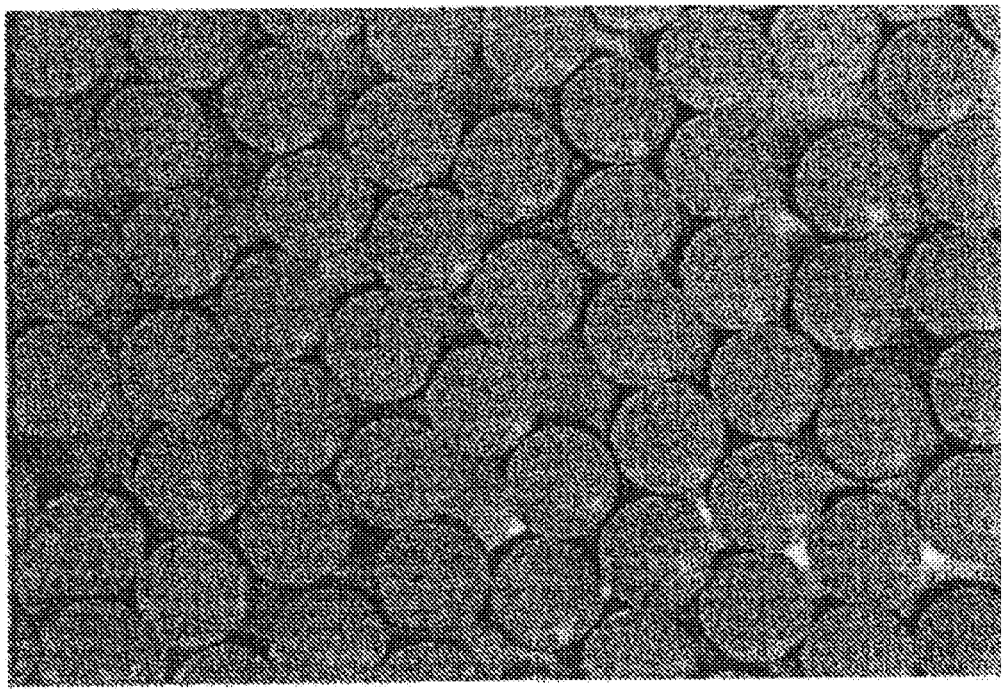
FIG. 8 is a photograph of pellets manufactured after missing magnesium stearate with radioactive waste.

The result of manufacturing pellets after mixing magnesium stearate with radioactive waste is shown in FIGS. 8 and Table 4.

TABLE 4

Hardness measurement of actual waste

| Hardness (kp) | |
|---|---|
| 1 | 4.38 |
| 2 | 4.29 |
| 3 | 4.56 |
| 4 | 4.61 |
| 5 | 4.57 |
| Average | 4.48 |

TABLE 5

Friability measurement of actual waste

| Friability | |
|---|---|
| Before experiment (g) | After experiment (g) |
| 0.5401 | 0.5279 |
| 0.5478 | 0.5465 |
| 0.5642 | 0.5501 |
| 0.5732 | 0.5608 |
| 0.5761 | 0.5651 |
| 0.5821 | 0.5723 |
| 0.5773 | 0.5771 |
| 0.5948 | 0.5792 |
| 0.5854 | 0.5825 |
| 0.5917 | 0.5896 |
| 1.42% | |

The result of modeling glass composition and characteristic based on components of radioactive waste is as follows.

TABLE 6

Result table of glass composition and characteristic modeling for radioactive waste

| | Boric acid waste exclusive vitrification | | W1 + Boric acid waste mixed vitrification | |
|---|---|---|---|---|
| Composition | Compound (BF) | Vitrified solid (BG) | Compound (W1BF) | Vitrified solid (W1BG) |
| $Li_2O$ | 14.42 | 9.39 | 12.87 | 7.73 |
| $B_2O_3$ | — | 29.76 | — | 27.24 |
| $Na_2O$ | 1.92 | 6.09 | 4.46 | 7.64 |
| MgO | — | 0.04 | 0.98 | 1.12 |
| $Al_2O_3$ | 21.04 | 13.68 | 21.29 | 13.62 |
| $SiO_2$ | 59.62 | 38.79 | 57.43 | 38.30 |
| $K_2O$ | — | 0.14 | — | 0.50 |
| CaO | — | 0.11 | 0.99 | 1.80 |
| $ZrO_2$ | 3.00 | 1.95 | 1.98 | 1.19 |
| $Fe_2O_3$ | — | 0.02 | — | 0.42 |
| $P_2O_5$ | — | | — | 0.09 |
| $TiO_2$ | — | | — | 0.29 |

TABLE 6-continued

Result table of glass composition and characteristic modeling for radioactive waste

| Composition | | Boric acid waste exclusive vitrification | | W1 + Boric acid waste mixed vitrification | |
|---|---|---|---|---|---|
| | | Compound (BF) | Vitrified solid (BG) | Compound (W1BF) | Vitrified solid (W1BG) |
| $MnO_2$ | | — | | — | 0.02 |
| ZnO | | — | 0.03 | — | 0.04 |
| Total | | 100 | 100 | 100 | 100 |
| Characteristic | Waste content (wt %) | — | 35% | — | 40% |
| | Viscosity(poise) | 168 | 6 | 153 | 8 |
| | Electrical conductivity | — | 62 | — | 47 |
| | Density(g/cm$^3$) | — | 2.47 | — | 2.51 |
| Leaching rate (g/m$^2$) | Si | — | 0.24 | — | 0.22 |
| | B | — | 4.16 | — | 3.13 |
| | Na | — | 1.48 | — | 1.48 |
| | Li | — | 3.09 | — | 2.45 |

The result of glass manufacture experiment in laboratory to vitrify radioactive waste is as follows.

TABLE 7

Characteristic of glass manufactured in radioactive waste laboratory

| Item | | Boric acid waste purposed vitrified solid | W1 + Boric acid waste vitrified solid | Standard glass |
|---|---|---|---|---|
| Sample name | | BG | W1BG | SRL-EA |
| Experiment duration | | 7 days | 7 days | |
| Oven temperature | | 90° C. | 90° C. | |
| Sample size | | 100-200 mesh | 100-200 mesh | |
| Quantity of sample/ quantity of desalted water | | 5 g/50 ml | 5 g/50 ml | |
| Leaching water pH | | 9.75 | 9.82 | |
| Leaching rate (g/m$^2$) | Si | 0.01 | 0.01 | <2 |
| | B | 0.46 | 0.22 | <9 |
| | Na | 0.12 | 0.13 | <6 |
| | Li | 0.39 | 0.21 | <5 |

Figure 9:
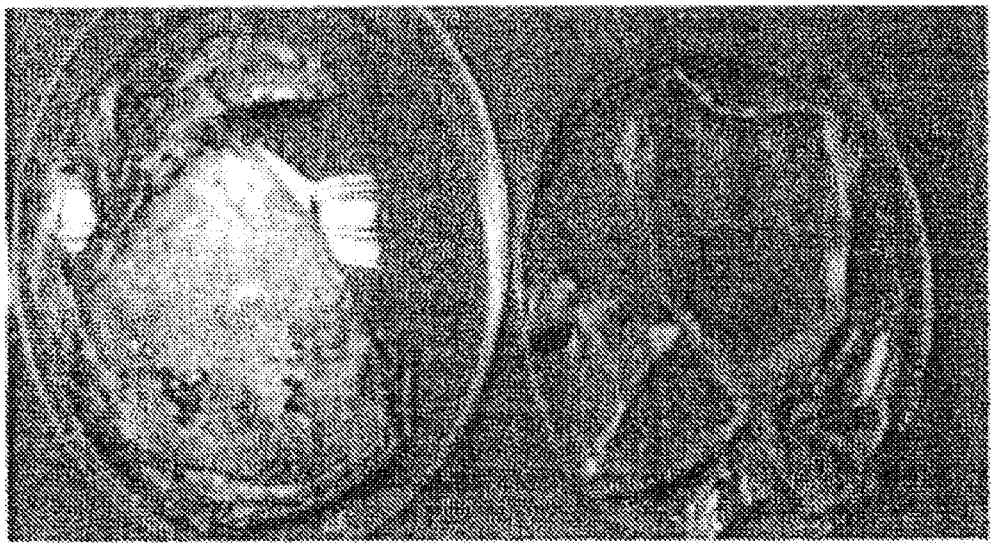
FIG. 9 is a photograph showing the form of solids produced after vitrifying radioactive waste.

The form of solid after vitrifying the radioactive waste is shown in FIG. 9.

What is claimed is:

1. An apparatus for the granulation of radioactive waste comprising:

a body frame having an inlet and an outlet;

a hopper supplying the radioactive waste to be transferred and fed through the inlet;

a feeder transferring/supplying the radioactive waste supplied through the hopper to a specific position and in a certain quantity;

a stirrer pulverizing/mixing lumps of the radioactive waste supplied through the hopper;

an additive supply part disposed at a side of the stirrer to supply a lubricant to the radioactive waste fed into the stirrer; and a pellet press pressing the radioactive waste fed through the feeder into a pellet and discharging the pellet of radioactive waste through the outlet.

2. The apparatus of claim 1, further comprising a pollution spread preventing film installed around body frame to prevent pollution spreading that may occur during manufacturing of the pellet.

3. The apparatus of claim 2, further comprising an exhaust pipe on a top portion of the pollution spread preventing film to discharge dust.

4. The apparatus of claim 1, further comprising a sleeve glove on a side of the body frame for inspection and work inside the body frame.

5. A method of pelletizing radioactive waste, the method comprising:

analyzing composition, particle size, and distribution of the radioactive waste;

adding a lubricant to the radioactive waste and mixing together the lubricant and the radioactive waste to produce mixed radioactive waste;

feeding the mixed radioactive waste into a pellet press and pressing the mixed radioactive waste into pellet shape;

determining whether the pellet meets criteria and, if not, making adjustments; and transferring the pellet into a vitrification facility.

6. The method of claim 5, wherein the criteria for the are 4-7 kp hardness and no more than 2% friability.

7. The method of claim 5, wherein the lubricant is selected from the group consisting of stearate, magnesium stearate, and calcium stearate, and is added in an amount of 0-2 wt %.

8. The method of claim 5, wherein the radioactive waste including pressing the radioactive waste with 70-80 kg/mm$^2$ pressure to form the pellet.

9. A vitrification method comprising:

identifying a change in composition of radioactive waste by analyzing physical and chemical attributes of radioactive waste by analyzing of composition, particle size and distribution of the radioactive waste as in claim 5;

identifying vitrification through glass composition and attribute modeling;

identifying suitability in vitrification through laboratory characteristic experiments based on modeling results; and approving soundness of vitrified solid through practical experiment and attribute experiments based on the laboratory experiments.

* * * * *